United States Patent [19]

Dinand

[11] Patent Number: 4,925,043

[45] Date of Patent: May 15, 1990

[54] CLOSURE DEVICE FOR CONTAINERS

[75] Inventor: Pierre F. Dinand, Levallois-Perret, France

[73] Assignee: R. P. Denis S.p.A., Italy

[21] Appl. No.: 324,908

[22] Filed: Mar. 17, 1989

[30] Foreign Application Priority Data

Apr. 1, 1988 [IT] Italy ..... 20077 A/88

[51] Int. Cl.[5] ..... B65D 45/00

[52] U.S. Cl. ..... 215/322; 220/348

[58] Field of Search ..... 215/322; 220/345, 346, 220/347, 348, 252; 222/560, 561

[56] References Cited

U.S. PATENT DOCUMENTS

| | | | |
|---|---|---|---|
| 2,133,651 | 10/1938 | Baker | 220/345 X |
| 2,256,095 | 9/1941 | Maloney | 222/560 |
| 2,370,997 | 3/1945 | Rudolph | 215/322 X |

*Primary Examiner*—Stephen Marcus

*Attorney, Agent, or Firm*—Steinberg & Raskin

[57] ABSTRACT

A closure device for a container provided with an aperture, comprising a slider carrying a stopper and slidable within guides provided on the container, the stopper and/or the aperture being elastically deformable such that by using a suitable trajectory for the slider, snap-closure of the container is obtained by virtue of the elasticity.

8 Claims, 1 Drawing Sheet

CLOSURE DEVICE FOR CONTAINERS

BACKGROUND OF THE INVENTION

This invention relates to a closure device for containers, particularly for containers containing a liquid and consisting of a body provided with an aperture closed by a stopper.

To use the liquid contained in such a container, the user must first remove the stopper from the aperture. After this, the stopper is generally laid down or is held in one hand of the user. This leads to various problems. Firstly, it is possible for the stopper to fall to the ground and be lost or to be forgotten where laid after the liquid has been used from the container. Secondly, the user may find that holding the stopper in his hand while using the liquid is a nuisance, especially if the user needs to use both his hands when using the liquid.

SUMMARY OF THE INVENTION

An object of the present invention is therefore to provide a closure device for containers of the said type which obviates the aforesaid problems.

A further object is to provide a container closure device which is simple to construct and use.

These and further objects which will be apparent to one skilled in the art are attained by a closure device for a container provided with an aperture, which comprises a slider carrying a stopper and slidable within guides provided on said container, said stopper and/or said aperture being elastically deformable such that by using a suitable trajectory for said slider, snap-closure of the container is obtained by virtue of said elasticity.

BRIEF DESCRIPTION OF THE DRAWINGS

The present invention will be described in more detail from the accompanying drawings which are provided by way of non-limiting example and in which.

DESCRIPTION OF THE PREFERRED EMBODIMENTS

Figure 1:
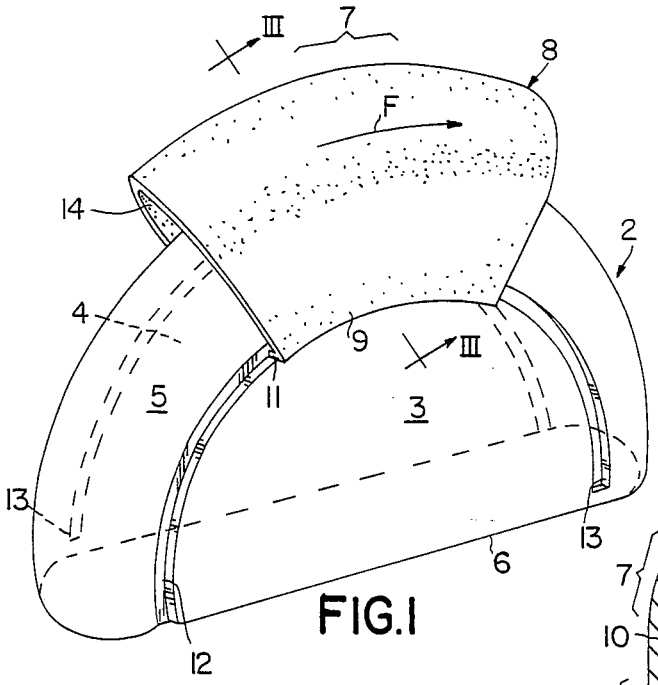
FIG. 1 is a side perspective view of container to which the closure device according to the present invention is applied.

With reference to said figures the closure device of the present invention is applied to a perfume container 1 comprising a body 2 with opposing flat faces 3 and 4, a bulbous part 5 connecting said faces 3 and 4, and a flat support base 6.

The closure device comprises a substantially rigid slider 7 having a body 8 curved elastically over the body 2 of the container 1 and provided with sides 9. On each inner face 10 of said sides 9 facing the body 2 of the container 1 there is provided a projecting edge 11 cooperating with a guide track or more simply a guide 12 which is provided in each of the opposing faces 3 and 4 of said container 1 and is interrupted at one end 13 to form a stop ledge for the movement of the slider 7 along the body 2 of the container 1.

Figure 3:
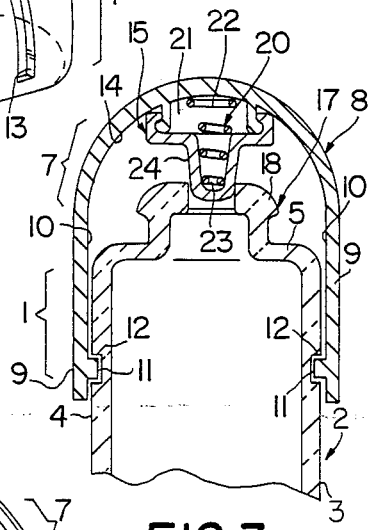
FIG. 3 is a section on the line III-III of FIG. 1.
Figure 2:
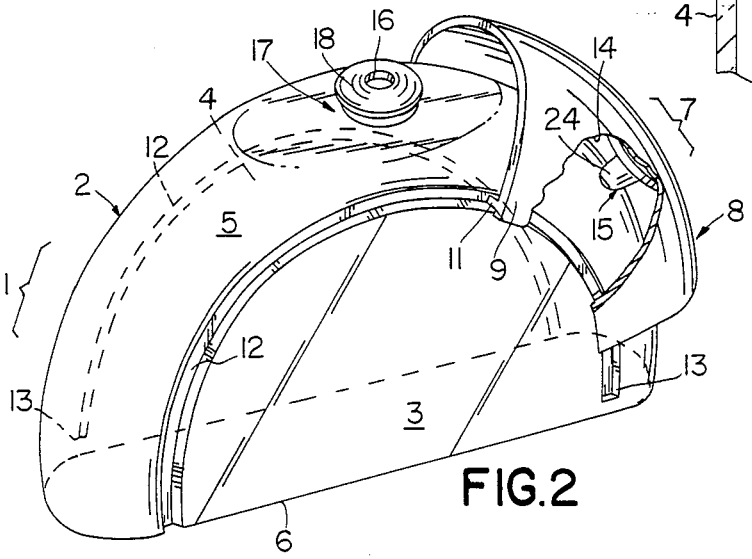
FIG. 2 is a perspective view of the container of FIG. 1, but with the device shown partly in section and in a different position from that of FIG. 1.

As illustrated in FIGS. 1 and 3, the guides 12 are curvilinear. However, the guides 12 may equally be rectilinear.

These stop ledges are provided advantageously in both the guides 12 in the opposing faces 3 and 4 of the container 1 but in opposite positions. In this manner on sliding the slider 7 along the container 1 in both direction, the slider does not separate from the body 2 of said container.

On that inner part 14 facing the bulbous part 5 of the body 2 of the container 1, the slider 7 supports in any known manner a stopper 15 arranged to cooperate with an aperture 16 provided in a substantially cylindrical element 17 projecting upperly from said bulbous part 5.

To facilitate the introduction of the stopper 15 into the aperture 16 (from which the perfume contained in the container emerges), at least one of said elements 15 and 17 is constructed of elastically deformable material. In addition, again for the stated reason, the element 17 upperly comprises a lead-in 18 of substantially spherical-cap shape flattened at its summit where said aperture 16 is present.

Finally to improve the seal in the engagement between the stopper 15 and aperture 16, an elastic means or spring 20 is associated with at least one of said elements. More specifically, the elastic means 20, associated with the stopper 15 and/or the element 17 in which the aperture 16 is provided, are able to improve the seal in the engagement between the stopper 15 and the aperture 16.

Specifically (see FIG. 3), the stopper 15 comprises an inner cavity 21 housing the spring 20, said spring having one end 22 resting against the inner part 14 of the body 8 of the slider 7 and its other end 23 cooperating with a substantially frusto-conical part 24 of the stopper 15. The spring 20 presses against the part 24 to urge it, during the engagement between the stopper 15 and aperture 16, to insert itself into said aperture and remain in said position by force, so increasing the seal in said engagement.

Alternatively, if the element 17 is constructed of elastically deformable material, elastic means analogous to that used in the aforesaid case is associated with said element 17, to enable the same results to be obtained in the engagement between the stopper 15 and aperture 16 is heretofore described. In other words, the aperture 16 may be provided with the elastically deformable element 17, with the stopper 15 comprising a projecting lead-in 24 to facilitate insertion of the stopper 15 into the aperture 16.

If it is now required to open the previously closed container 1 the slider 7 is made to slide along the guides 12 (arrow F in FIG. 1). As a result of this action and because of the elasticity of at least one of the elements 16 and 17 (the stopper and the element comprising and aperture 16, respectively), the stopper 15 disengaged from the aperture 16.

The user can then dispense the perfume contained in the container 1, during which the slider 7 and the relative stopper 15 remain secured to said container because of the stop ledges 13 in the guides 12.

If the container is now to be closed, the slider 7 is slid along the guides 12 until the stopper 15 is brought into contact with the element 17. At this point, on overcoming the small resistance to sliding provided by the contact between the stopper 15 and element 17, the elasticity of at least one of said elements 15 and 17 (in the described case stopper 15) results in the snap-insertion of the stopper 15 into the aperture 16 and thus the closure of the container.

A closure device constructed as described solves the aforesaid problems caused by the separation of the stopper from the container.

In addition, said device is simple to construct and use.

I claim:

1. A closure device for a container (1) provided with an aperture (16), comprising a slider (7) carrying a stopper (15) and slidable within guides (12) provided on said container (1), at least one of said stopper (15) and a slide of said aperature (16) being elastically deformable such that, by using a suitable trajectory for said slider (7), snap-closure of said stopper (15) within said aperature (16) of said container (1) is obtained, wherein said stopper (15) is constructed of elastically deformable material, and said aperature (16) is provided in an element (17) projecting from a body (2) of said container (1) and comprising a lead-in (18) proximate to said aperture (16).

2. The device of claim 1, wherein said element (17) projecting from said container body (2) is substantially cylindrically shaped, and said lead-in (18) thereon is substantially circular, to facilitate snap-fitting of said stopper 915) within said 3. The device of claim 1, wherein said lead-in (18) is substantially spherically-cap shaped and flattened at a summit thereof where said aperture (16) is located.

4. A closure device for a container (1) provided with an aperature (16), comprising a slider (7) carrying a stopper (15) and slidable within guides (12) provided on said container (1), at least one of said stopper 915) and a side of said aperature (16) being elastically deformable such that, by using a suitable trajectory for said slider (7), snap-closure of said stopper (15) within said aperature (16) of said container (1) is obtained, wherein said guides (12) are constituted by grooves provided in opposing faces (3, 4) of said container (1) and comprise stop ledges (13) for limiting movement of said slider (7).

5. A closure device for a container (1) provided with an aperature (16), comprising a slider (7) carrying a stopper (15) and slidable within guides (12) provided on said container (1), at least one of said stopper (15) and a side of said aperature (16) being elastically deformable such that, by using a suitable trajectory for said slider (7), snap-closure of said stopper (15) within said aperature (16) of said container (1) is obtained, wherein said slider (7) is substantially rigid and comprises sides (9) carrying means (11) arranged for cooperating with said guides (12) of said container (1).

6. A closure device for a container (1) provided with an aperature (16), comprising a slider (7) carrying a stopper (15) and slidable within guides (12) provided on said container (1), at least one of said stopper 915) and a side of said aperature (16) being elastically deformable such that, by using a suitable trajectory for said slider (7), snap-closure of said stopper (15) within said aperature (16) of said container (1) is obtained, wherein said aperature (16) comprises a substantially circular cross-section, and said stopper (5) comprises a substantially circular cross-section, with said stopper (15) and aperature (16) shaped substantially complementary to one another, such that said stopper (1) can snap into and fit within said aperature (16), when said container (1) is closed.

7. A closure device for a container (1) provided with an aperture (16), comprising a slider (7) carrying a stopper (15) and slidable within guides (12) provided on said container (1), at least one of said stopper (15) and a side of said aperature (16) being elastically deformable such that, by using a suitable trajectory for said slider (7), snap-closure of said stopper (15) within said aperature (16) of said container (1) is obtained, wherein said aperature (16) is provided in an elastically-deformable element (17) projecting from a body (2) of said container (1), said stopper (15) comprises a projecting lead-in (24) to facilitate insertion of said topper (15) into said aperature (16), and wherein said lead-in (24) is substantially frustoconically-shaped.

8. A closure device for a container (1) provided with an aperature (16), comprising a slider (17) a stopper (15) and slidable within guides (12) provided on said container (1), at least one of said stopper 915) and a side of said aperature (16) being elastically deformable such that, by using a suitable trajectory for said slider (7), snap-closure of said stopper (15) within said aperature (16) of said container (1) is obtained, wherein said slider (7) comprises an extended body (8) slidably mounted in said guides (12) provided on said container (1), said stopper (15) is mounted on an inner surface (14) of said slider body (8) to extend away from said inner surface (14) towards said container (1) and aperature (16) therein, and said aperature (16) is provided in a portion of an outer surface of a body (2) of said container (1), whereby sliding of said slider (7) along said guides (12) causes said stopper (15) to snap into engagement in said aperature (16) when passing thereover, and to be released from engagement from said aperature (16) when said slider (7) is moved to a location other than where said stopper (15) is situated directly above said aperature (16).

* * * * *